United States Patent [19]

Zuccarelli

[11] Patent Number: 4,680,856

[45] Date of Patent: Jul. 21, 1987

[54] PROCESS FOR FORMING AN ACOUSTIC MONITORING DEVICE

[76] Inventor: Hugo Zuccarelli, Corso Roma, 35, 15059 Monleale (AL), Italy

[21] Appl. No.: 816,211

[22] Filed: Jan. 6, 1986

Related U.S. Application Data

[63] Continuation of Ser. No. 591,714, Mar. 21, 1984, abandoned, which is a continuation-in-part of Ser. No. 313,027, Oct. 19, 1981, abandoned.

[51] Int. Cl.[4] ..... H04R 31/00

[52] U.S. Cl. ..... 29/594; 181/129; 264/222; 264/DIG. 30

[58] Field of Search ..... 29/594; 179/1 G, 1 GA, 179/1 MF, 107, 121 R, 121 D, 147, 153, 156 R, 182 R, 182 A; 181/129, 134, 135; 381/25, 26; 264/DIG. 30, 222, 220

[56] References Cited

U.S. PATENT DOCUMENTS 3,985,960 10/1976 Wallace, Jr. ..... 179/1 G

FOREIGN PATENT DOCUMENTS 2437373 2/1976 Fed. Rep. of Germany .

*Primary Examiner*—Carl E. Hall

*Attorney, Agent, or Firm*—Stetina and Brunda

[57] ABSTRACT

An acoustic monitoring device for sound sensing in the recording, reproduction, broadcasting, or transmission of sounds, and a process for forming the device. The acoustic monitoring device is shaped like a human head equipped with anatomical features which accurately reproduce the shape of the auricles, the auditory meatus, the Eustachian tubes, and the nasal and oral cavities. Membranes responsive to sound pressures are located at the positions of the ear drums or other auditory organs. The device is produced by a process that includes forming a first mold on a human head, forming a casting from that mold, forming a second mold on the casting, and painting the second mold with a liquid silicone rubber which is allowed to dry to form resilient casting segments simulating the human head. Anatomical features simulating the brain and internal members defining the Eustachian tubes and the nasal and oral cavities are provided within a skull model. A pair of membranes is placed within the skull model at the location of the eardrums or other auditory organs. These membranes are coupled to acoustic members which provide electrical signals on wires exiting the skull model. The silicon rubber casting segments are transferred to the exterior of the skull model giving the acoustic monitoring device the appearance and characteristics of the original human head.

6 Claims, 3 Drawing Figures

Fig. 1
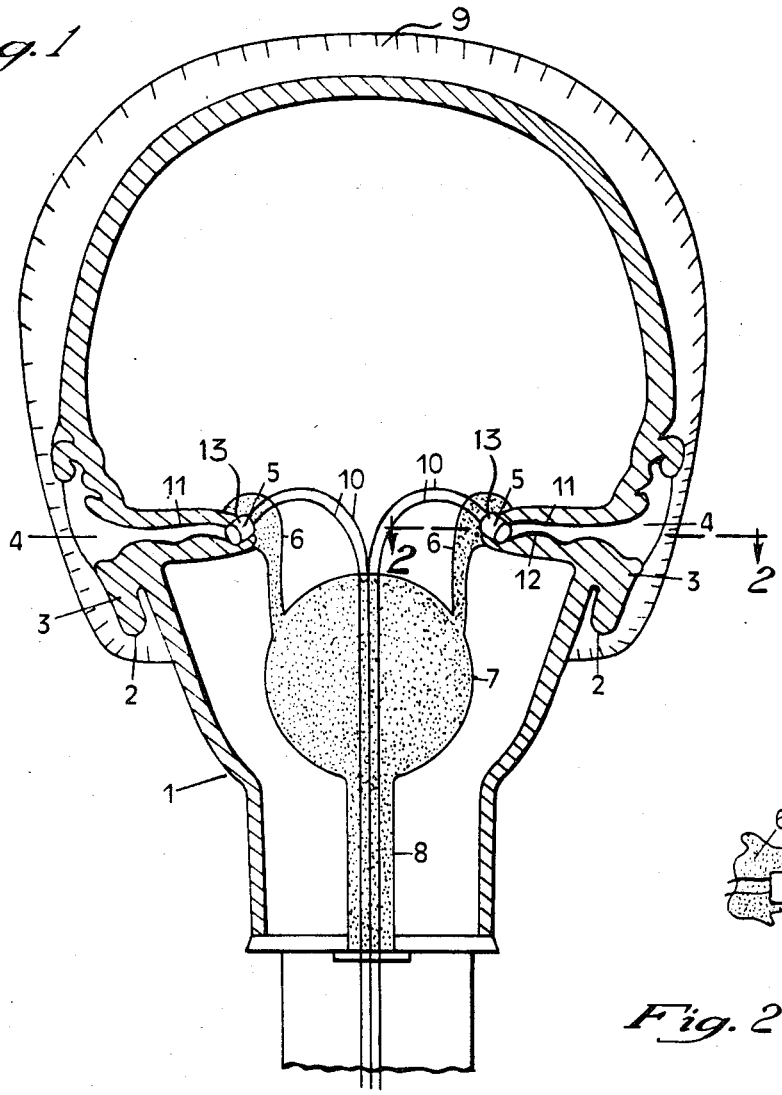
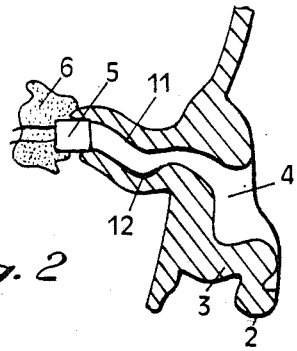
Fig. 2
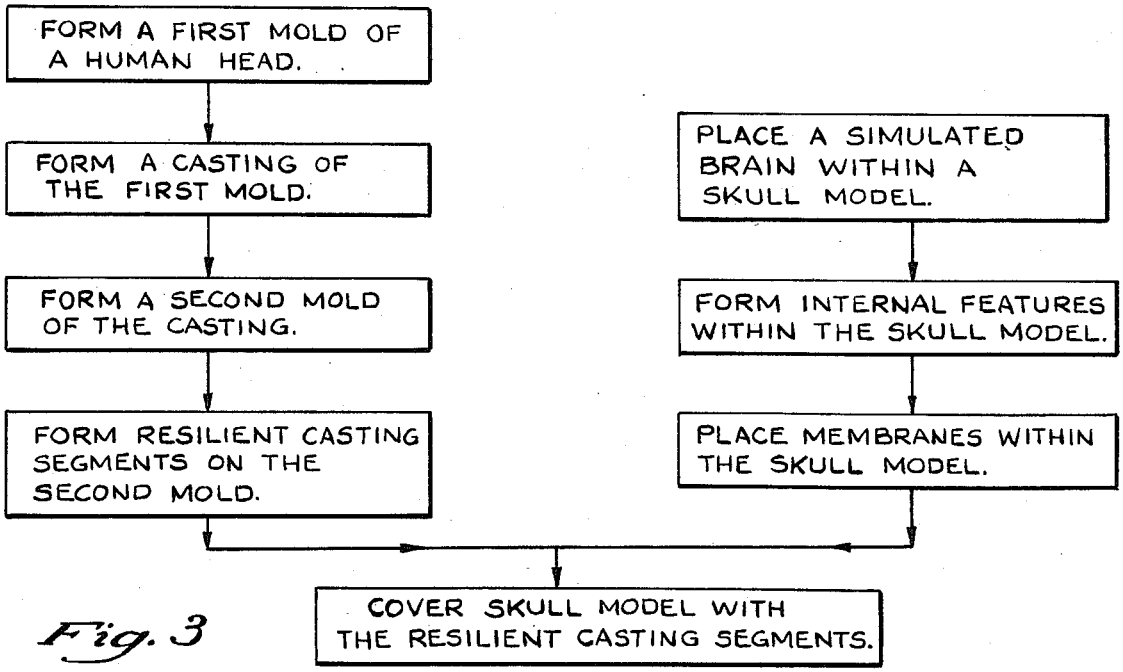
Fig. 3

PROCESS FOR FORMING AN ACOUSTIC MONITORING DEVICE

CROSS REFERENCE TO RELATED APPLICATION

This application is a continuation of U.S. patent application Ser. No. 591,714 filed Mar. 21, 1984, now abandoned, which is a continuation-in-part of U.S. patent application Ser. No. 313,027, filed Oct. 19, 1981, now abandoned.

BACKGROUND OF THE INVENTION

The present invention concerns an acoustic monitoring device usable in a system for sound sensing, in the spatial codification or "Holophonic" recording, reproduction or broadcasting of sounds, and to a process for forming such an acoustic monitoring device. More particularly, the present invention concerns a device, and a process for forming the device, which device allows sound sensing in the recording, reproduction or transmission of acoustic perceptions in a manner giving listeners an effective spatial and true, total dimensional effect, rather than a merely bidimensional one.

Stereophonic recording has been done by placing two or more microphones in strategic points and recording sounds on a record or tape in two separate tracks. The sounds recorded on the two separate tracks are then reproduced through two strategically placed speakers. In another so-called "binaural" recording system, an object shaped like a human head is placed between two panoramic microphones, so as to artificially create an acoustic shadow to separate the two recorded stereo channels. Another existing device consists of an artificial head equipped with internal microphones. This device provides only a limited and imperfect stereophonic sound recording, and its full effect can only be appreciated by use of earphones or headphones because it uses physical delays and physiological delays created by differences in sound intensity between the two channels, or a shadowing effect. Still such device does not provide a Holophonic effect.

The present invention is the result of in-depth research and study and results from another interpretation of the way in which sound energy interacts with the human auditory system. Starting from this interpretation, the present invention provides a system which is able to give a true perception of the sound received. The invention can be considered to provide for the auditory system what laser holography provides for the visual system and thus can be considered holography of sound, or "Holophonics."

An examination of the hearing system shows that it must analyze information from various sound sources. In animals in general, the hearing system dynamically analyzes sound information by the sensorial effect of the entire body, as well as by spatial codification through the ears. In man, a highly evolved animal with a highly perfected hearing system, the hearing system performs an instantaneous static analysis of sound information, giving the position of the sound source with respect to the listener.

This human auditory system includes numerous features that contribute to the overall perception of sound received by a person. These anatomical features include the ears and their auricles and auditory meatus, the Eustachian tubes, and the nasal and oral cavities. In order to provide an acoustic monitoring device permitting accurate reproduction of auditory sensations, these anatomical features must be accurately reproduced. Hair is also of considerable importance in spatial discrimination, allowing a precise perception of sound coming from the front or the rear by giving rise to an asymmetric hologram. In fact, bald persons have been observed to have somewhat reduced front-rear discrimination along the axis of symmetry of the head.

SUMMARY OF THE INVENTION

The present invention is an acoustic monitoring device and a process for forming such an acoustic monitoring device. The acoustic monitoring device is usable for sound sensing in Holophonic sound recording, reproduction, transmission and broadcasting systems. The acoustic monitoring device is shaped like a human head, equipped with anatomical features which accurately reproduce the shape of the auricles, the auditory meatus, the Eustachian tubes and the oral cavity, as well as with a wig which serves to generate asymmetry for front-rear discrimination. Within the acoustic monitoring device, at the end of each auditory meatus, is a membrane having a cardioid shape, preferably no smaller than seven millimeters in maximum dimension, which moves in accordance with the pressures to which it is subjected, including incoming and outgoing sound pressures.

The acoustic monitoring device is formed by a process that insures that it reproduces as nearly as possible the characteristics of the human head, particularly the size and shape of the auricles and the auditory meatus, but also including the Eustachian tubes, nasal cavities, and the oral cavity, as well as other components. Thus, to form the acoustic monitoring device, a first mold is formed on an actual human head by applying a molding material such as a dental alginate to the human head. This mold is preferably formed in segments covering the full human head, including the auricles, and the auditory meatus. When the mold has dried sufficiently, it is removed from the human head in its segments and assembled to form a full mold of the human head. A plaster dummy is then made from the first mold. This plaster dummy, thus, simulates the original human head. A plaster mold is made of the plaster dummy. After this second mold has hardened and been removed from the dummy, the surfaces of the second mold are painted with a liquid silicone rubber.

The human head from which the first mold was made is X-rayed or otherwise scanned to determine the size, shape, and location of its internal features, including its brain, Eustachian tubes, nasal cavities, and oral cavity. A simulated brain, of a consistency and resiliency simulating those of the human brain and having a size and shape substantially equal to the brain size and shape determined from the X-rays, is placed within a model of a human skull, preferably a plastic model having acoustic properties approximating those of a human skull such as a medical student might utilize for study. Representations of internal members within the human head are likewise formed of resilient material and are placed within the skull model, with appropriate size, shape and position to define cavities simulating features within the human head, such as the Eustachian tubes, the nasal cavities, and the oral cavity, as determined from the X-rays. A pair of membranes are placed within the skull model at positions simulating auditory organs of the human head. Vibrations of the membranes, resulting from the various pressures, are transformed to electrical signals, possibly afer mixing with other pressures such as reference auditory pressures, and are provided as an output signal on electrical wires which pass from the skull model, for example via a passageway communicating with the oral cavity.

After the silicone rubber has dried on the surfaces of the second mold, the resulting resilient solid material is transferred from the second mold to the exterior of the skull model, giving the acoustic monitoring device the appearance and characteristics of the original human head. The resulting acoustic monitoring device permits realistic sound recording, providing the "Holophonic" effect discussed above.

Preferably, the acoustic monitoring device is provided with a wig, a tongue, teeth, and a heating system which maintains its internal temperature approximately at that of a human head, about 98.6° F.

In the human head, and thus preferably also in the acoustic monitoring device of the present invention, each cavity acting as an auditory meatus is in the shape of an elliptical cylinder twisted on its axis so that the wall which is behind the internal orifice inclines gradually. That is, each auditory canal has a cross-sectional torsion over the length thereof to cause the longitudinal extension of a point on the lower surface thereof adjacent the auricle to be on the upper surface thereof adjacent the eardrum. Further, preferably there is an abrupt dilation along the length of the auditory canal intermediate the ends thereof. In the acoustic monitoring device each cavity acting as auditory meatus preferably has an average length along its axis in the range of from about 24 mm to about 40 mm, simulating the average length of an actual human auditory meatus. The outer approximately one-third of the length of the auditory meatus, adjacent the auricle, is made of the same resilient solid material as the auricle. The inner two-thirds of the length has a covering layer of more rigid material. Thus, the surface of the auditory meatus in the device simulates the outer fibro-cartilaginous portion and the inner body portion of the auditory meatus of the human head.

BRIEF DESCRIPTION OF THE DRAWINGS

The process and the device of the present invention are described below in a presently preferred form, given only as a non-limiting and ilustrative example, with reference to the attached drawings in which:

FIG. 1 is a schematic, longitudinal sectional view of an acoustic monitoring device made in accordance with the present invention, the view being taken through the auditory meatus cavities;

FIG. 2 is an enlarged transverse sectional view taken along line 2—2 of FIG. 1 and showing an aurical and an auditory meatus of the acoustic monitoring device of FIG. 1; and FIG. 3 is a flow chart illustrating a process for forming an acoustic monitoring device in accordance with the present invention.

DETAILED DESCRIPTION

Acoustic monitoring device 1, depicted in FIGS. 1 and 2, is shaped like a human head and is provided with two ears 2, each having an auricle 3, which accurately simulates the auricle of a human ear, and a canal or cavity 4, which accurately simulates the auditory meatus. A membrane 5 is provided in each ear 2 and can be placed in the same position and orientation as the eardrum of the ear, as depicted in FIGS. 1 and 2, or can be placed at the locations of the inner ears or other auditory organs. Each membrane 5 is in free communication with a tubular cavity 6 which accurately reproduces the shape of the Eustachian tubes. These cavities 6, in turn, are in communication with a central cavity 7 which accurately reproduces the shape of the nasal cavities and the oral cavity and which, itself, is in communication with the outside through a tubular cavity 8.

Preferably each auditory meatus cavity 4 has a length in the range of from about 24 mm to about 40 mm, and auricles 3 and the outer approximately one-third of each auditory meatus cavity 4 are preferably made of a resilient material such as a silicone rubber to simulate the fibro-cartilaginous body material, while the inner two-thirds of each cavity 4 has an interior layer 11 of plastic, plaster, or the like, to simulate the bony portions of the middle ear. The top of acoustic monitoring device 1 is covered with a wig 9 to provide front to rear asymmetry to permit front-rear discrimination. Membranes 5 are coupled by appropriate acoustic members to provide on wires 10 electrical signals representing sensed pressures, including monitored acoustic pressures. Wires 10 pass from tubular cavity 6 through central cavity 7 and exit acoustic monitoring device 1 through tubular cavity 8.

Many microphones are covered with a porous material such as stretched polyurethane to eliminate the so-called "pop" effect which otherwise would be experienced. The human ears, and therefore according to this invention acoustic monitoring device 1, have in each auditory meatus 4 a sharp dilation 12 which acts like the muffler of an internal combustion engine for eliminating this "pop" effect. Therefore, the membranes 5 may be exposed without exhibiting this effect. Each membrane 5 preferably has a cardioid shape no smaller than 7 mm in maximum dimension. Each cavity 4, acting as an auditory meatus, has a cross-section of an elliptical cylinder, with twisting of its axis such that the longitudinal extension of a point on the lower surface thereof adjacent the auricle is on the upper surface thereof adjacent membrane 5.

FIG. 3 is a flow chart illustrating a process for forming an acoustic monitoring device in accordance with the present invention. A mold of a person's head is formed by covering the head with a suitable molding material. Dental alginate is preferred, since it does not harm the flesh. The alginate powder is mixed with water in accordance with the alginate directions, and the resulting material is applied to the head with sufficient pressure to cause the material to assume the shape of the head. A hand syringe is used to inject the alginate material into the ear canal. The head is preferably covered in segments, and as each segment reaches an appropriate dryness, it is removed and stored until all segments are completed. Such segments might be the face and neck in one segment, the back of the head in two segments, and the ears.

The mold segments are then assembled to form a full head mold. That mold is filled with plaster to form a plaster casting of the person's head. Preferably, the molds of the person's auricles are not assembled to the full head mold, since the inclusion of the auricles in the head casting would make removal of the casting from the mold difficult. Instead the auricles are cast separately and subsequently attached to the head casting.

A second mold is then made of the full head casting. This second mold is made of a sturdier material than the first mold. A plaster material is suitable. If necessary, the plaster head casting can be coated with a release agent to assure that the plaster mold does not adhere to the plaster head casting. The second mold is likewise formed in segments to facilitate its removal from the head casting. After the second mold segments are dried and removed from the head casting, the contact surface of each segment, i.e. the surface of the segment that was in contact with the head casting, is painted with a liquid silicone rubber which is then allowed to dry and harden, forming a set of resilient casting segments of the human head.

X-rays are taken of the person's head which was used to make the first mold. From the X-rays, the size and shape of the person's skull and the size, shape, and exact positioning of internal features of the person's head are determined. A plastic skull model is then modified as necessary to conform to the size and shape of the person's skull as determined from the X-rays. Such modification might include cutting the skull model and adding plastic material to enlarge it or cutting the skull model and removing material so as to make it smaller. A suitable plastic skull model might be obtained from an educational supply store, by way of example.

A resilient member of the size and shape of the person's brain is formed. This simulated brain might be formed of a polyethylene bag filled with a mixture of water, alcohol, and cellulose having a density, resiliency, and consistency simulating those of the brain. Alternatively, a silicone rubber material is suitable for this, since such material has acoustic properties near those of the human brain. This simulated brain member is then installed within the skull model in the position and orientation of the person's brain as determined from the X-rays. Likewise, material is used to fashion other internal features of the person's head, for example the cartilage and other material within the head defining the Eustachian tubes, the nasal cavities and the oral cavity. These tubes and cavities are fashioned to simulate as nearly as possible the corresponding features of the person's head as determined from the X-rays. These features can be formed of an elastomer such as silicone rubber or a suitable polyester, mixed with suitable catalyzers, hardeners, and/or softeners to provide the desired hardness or resiliency and other characteristics. The person's tongue, teeth and neck vertabrae are similarly simulated and attached to the skull model.

Two membranes 5 are installed in the locations of the ear drums, as illustrated in FIG. 1. Within acoustic monitoring device 1 various acoustic members are coupled to membranes 5 to complete the Holophonic sound processing, with the resulting signals passing via wires 10 to suitable recording, reproducing or other processing equipment. Preferably, a thermostat and a heater are installed to maintain the temperature of the skull model at approximately the temperature of a human head; i.e. about 98.6° F. The necessary wiring for the Holophonic signals and for the temperature control exit the skull model through the neck for connection to appropriate circuitry.

Finally, the resilient casting segments of the human head are removed from the second set of mold segments and are used to cover the skull model, completing the acoustic monitoring device.

This process, including forming the mold on an actual human head, has been found to provide an acoustic monitoring device providing realistic sound recording, reproduction, transmission and broadcasting, referred to as "Holophonic" sound which has been found to be a unique sound technique.

Although the present invention has been described with reference to preferred embodiments, modifications and rearrangements can be made and the result would still be within the scope of the invention.

What is claimed is:

1. A process for forming an acoustic monitoring device shaped like a human head for sound sensing, said process comprising the steps of:

(a) applying a first molding material to a human head to form a first mold thereof, such application being done in segments to provide said first mold in segments, (b) removing said first mold segments from the human head;

(c) assembling said first mold segments to form a full head mold;

(d) applying a second material to said full head mold to form a full head casting of the human head;

(e) removing said full head casting from said full head mold;

(f) applying a further molding material to said full head casting to form a second mold, such application being done in segments to provide said second mold in segments;

(g) removing said second mold segments from said head casting;

(h) applying to each of said second mold segments a liquid material dryable to a resilient solid material;

(i) allowing the liquid material to dry to form a set of resilient casting segments of the human head;

(j) providing within a human skull model a resilient member simulating the density, resiliency and consistency of the human brain of the human head;

(k) forming within said human skull model a plurality of members simulating the cartilage, Eustachian tubes, nasal cavities and the oral cavity of the human head;

(l) placing a pair of pressure-sensitive membranes within said skull model at positions simulating the auditory organs of the human head;

(m) coupling said membranes to electrical connections by means responsive to pressure on said membranes, for generating electrical signals representing sensed pressures, including monitored acoustic pressures; and (n) transferring said set of resilient casting segments from said second mold segments to the exterior of said skull model to simulate the exterior of the human head.

2. A process as claimed in claim 1 in which the first mold is formed by applying a dental alginate material to the human head and allowing the dental alginate material to dry and harden.

3. A process as claimed in claim 2 in which the applying of the first molding material to the human head includes applying the first molding material to the auditory meatus with a hand syringe.

4. A process as claimed in claim 3 in which the casting of the human head is formed by applying a plaster material to said head mold.

5. A process as claimed in claim 4 in which the second mold is formed by applying a plaster material to said head casting.

6. A process as claimed in claim 5 in which the set of resilient casting segments is formed by applying a liquid silicone rubber material to the contact surface of each of said second mold segments and allowing the liquid silicone rubber material to dry.

* * * * *